United States Patent [19]

Maier et al.

[11] 3,938,687

[45] Feb. 17, 1976

[54] BARREL OF SYNTHETIC MATERIAL

[75] Inventors: Eckhard Maier, Ettlingen; Heinrich Ostermeier, Herford; Kalman Körmendi, Karlsruhe; Friedel Schinke, Bunde, all of Germany

[73] Assignees: Elbatainer Kunststoff- und Verpackungs- Gesellschaft m.b.H., Ettlingen; Sulo Eisenwerk Streuber & Lohmann, Herford, both of Germany

[22] Filed: Nov. 1, 1973

[21] Appl. No.: 412,046

[30] Foreign Application Priority Data

Nov. 11, 1972 Germany ..... 2255299

[52] U.S. Cl. ..... 220/5 R; 217/72; 220/80; 220/319

[51] Int. Cl.[2] ..... B65D 11/06; B65D 45/32

[58] Field of Search ..... 217/3 CB, 72, 76, 77–79, 217/90–95; 220/55 AN, 5 R, 80, 319; 229/67

[56] References Cited

UNITED STATES PATENTS

| | | | |
|---|---|---|---|
| 165,909 | 7/1875 | Wyvell | 229/67 X |
| 1,398,298 | 11/1921 | Irvin | 220/5 R |
| 1,452,039 | 4/1923 | Gravell | 217/3 CB |
| 1,457,155 | 5/1923 | Fey | 220/5 R |
| 2,412,024 | 12/1946 | Young | 220/80 X |

FOREIGN PATENTS OR APPLICATIONS

| | | | |
|---|---|---|---|
| 16,109 | 11/1920 | France | 229/67 |
| 816,521 | 10/1951 | Germany | 217/72 |

*Primary Examiner*—Stanley N. Gilreath
*Assistant Examiner*—John M. Jillions
*Attorney, Agent, or Firm*—Ernest G. Montague; Karl F. Ross; Herbert Dubno

[57] ABSTRACT

Two symmetrical, axially separable barrel halves of plastic material are provided at their confronting end faces with peripheral edge beads each forming a set of axially projecting teeth alternating with gaps of like width, the teeth of each half fitting into the gaps of the other. The free ends of the teeth are provided with radially extending bosses forming two annular crenelations separated by a substantially flat ring zone upon the interfitting of the teeth, this zone receiving a broad strap inserted between the two crenelations to hold the barrel halves together. The peripheral edge beads are further provided, radially inwardly of the teeth and gaps, with axially extending tenons and mortises or equivalent tongue-and-groove formations to provide a supplemental bracing effect. The inner strap surface may be correspondingly beveled to exert upon the free tooth ends an elastic biasing force urging the two barrel halves toward each other in the axial direction. The barrel is internally lined with a plastic bag.

8 Claims, 5 Drawing Figures

BARREL OF SYNTHETIC MATERIAL

The present invention relates to a plastic barrel composed of two detachable, stackable halves. Elements for interlocking the halves, preferably with a container fitting tightly into the barrel, are located near the rim of each half. These barrels are specially suitable for filling in fatty or acidiferous goods.

Big-volume containers, such as barrels are relatively expensive, and this renders them unpractical as disposable containers, which can be discarded after use. Furthermore, they would create a garbage and bulk-freight problem. The repeated re-use of these containers often brings about considerable cleaning problems, especially when filling in fatty or acidiferous products.

Two-piece barrels are known which are composed of cup-shaped halves. These halves can interlock rim against rim. They are relatively easy to clean and can be transported in stacks. When put into use, they are connected with each other detachably, e.g. according to the German pat. No. 143,098 by screwing both halves on a threaded ring, or according to the German pat. No. 384,473 by connecting these halves with a crown rim by means of a strap. These known barrels are not easy to handle and not sufficiently resistant to transport, i.e. to impact and fall. This makes handling almost impossible.

Another two-piece barrel, described in the published pat. specification No. 1,611,911, has an undercut crown rim and hook-like border segments which lock behind the crown rim and are secured in position by a guard ring. The two pieces are identical and thus cause relatively high cost of tools and production. Their locking system is expensive and complicates the production to a large extent. Also, tolerances at the rims of the barrel havles are required. This makes tight interlocking difficult and sometimes impossible.

The general object of our invention is to provide a two-piece plastic barrel which can be produced cheaply, which is resistant to stresses developing in transport at the locking system, and whose sections can easily be tightly interlocked and separated. The invention also aims at easier storage and transportation as well as handling of the barrel, compared to the conventional containers of this type.

The foregoing objects are realized, in accordance with our present invention, by the provision of two symmetrical, axially separable barrel halves with confronting end faces meeting at a midplane transverse to the barrel axis, each of these halves being provided in the vicinity of that midplane with a peripheral edge bead forming a set of axially extending teeth alternating with gaps of substantially the same width. The teeth of each half overlie the edge bead of the other half and are received in the gaps thereof, their free ends projecting beyond the midplane and terminating in radially upstanding bosses which form a pair of parallel annular crenelations bounding a substantially flat ring zone defined by the interleaved teeth. A generally flat strap, inserted under tension between these crenelations, bears radially inwardly upon the ring zone to force the free ends of the teeth into firm contact with the underlying edge-bead areas forming the bottoms of the inter-teeth gaps.

Advantageously, pursuant to another feature of our invention, the edge beads are provided with axially extending bracing formations such as tenons and mortises, or annular grooves bridged by a set of peripherally spaced tongues, engaging each other across the midplane at locations radially inwardly from the aforementioned ring zone.

In accordance with a further feature of our invention, the areas underlying the free tooth ends are pitched with a radially inward slope away from the midplane. By providing the strap with edge portions of increased thickness, bearing upon these free ends, we achieve the exertion of a wedging effect giving rise to an axial biasing force which tends to hold the two barrel halves together.

The above and other features of our invention will now be described in detail with reference to the accompanying drawing in which.

Figure 1:
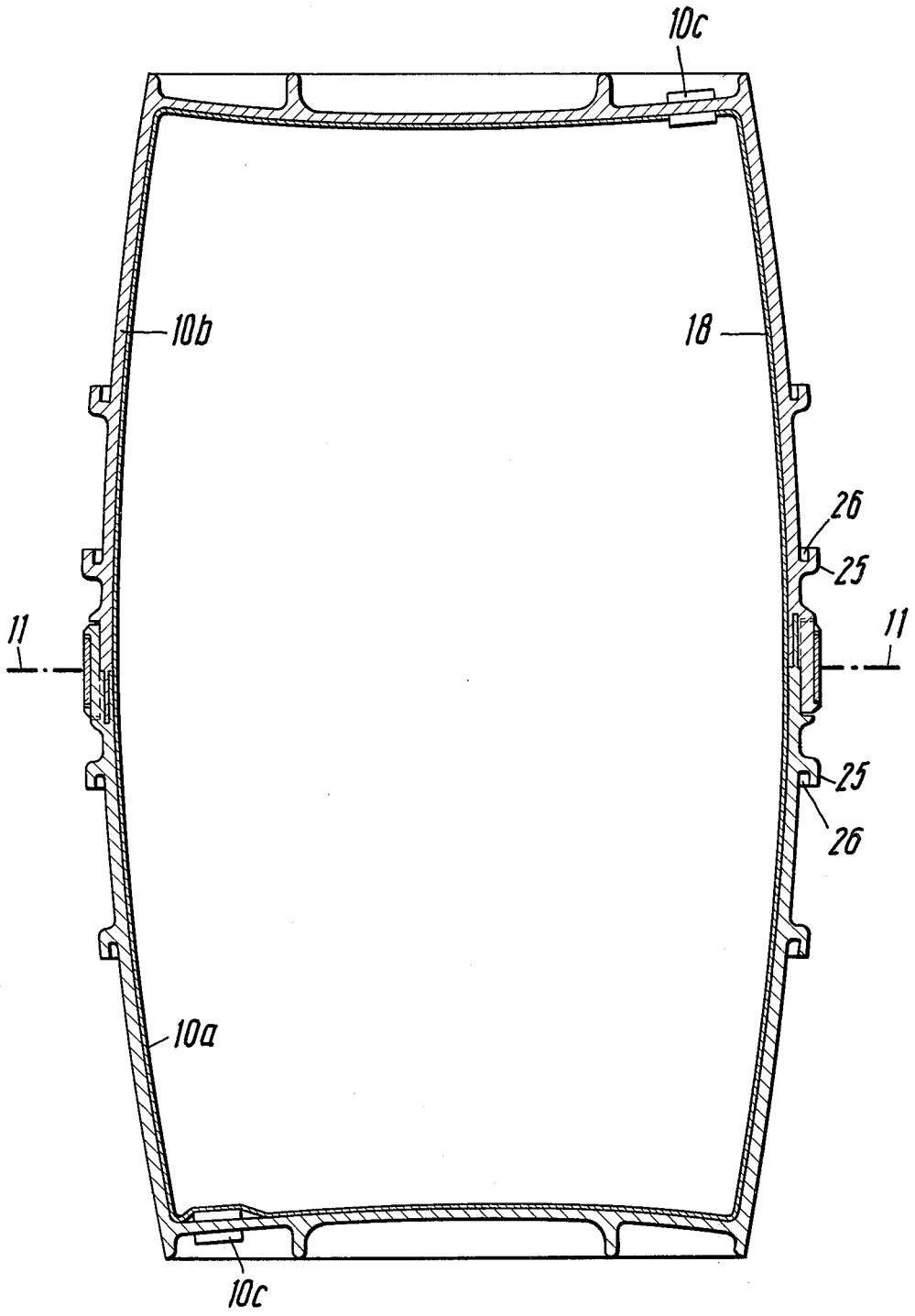
FIG. 1 is an axial sectional view of a barrel embodying our invention.

FIG. 1 shows a mainly conventional plastic barrel 10, consisting of two cup-shaped, slightly tapering halves 10a and **10*b* each provided with the usual bunghole 10*c*. In the median plane 11, transverse to the barrel axis, the barrel halves are fitted together with the aid of interlocking formations as shown in FIGS. 2 – 5**.

Figure 2:
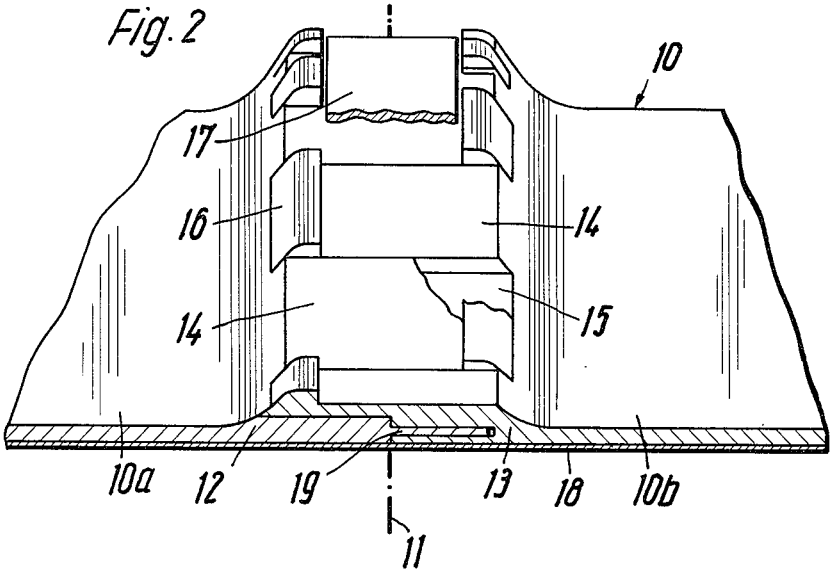
FIG. 2 is a fragmentary perspective view of the junction of the halves of the barrel of FIG. 1, drawn to a larger scale.
Figure 3:
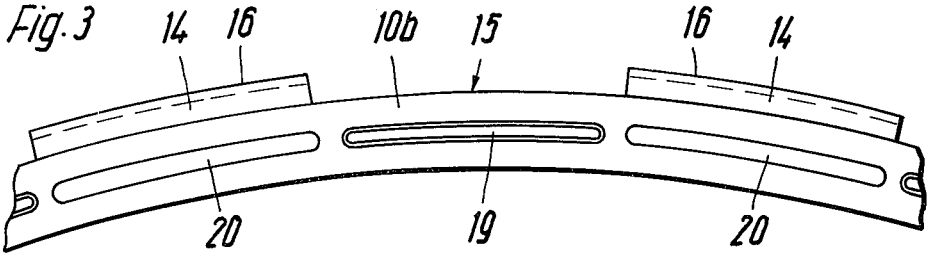
FIG. 3 is a fragmentary end view of one of the barrel halves, drawn to the same scale as FIG. 2.

In the embodiment of FIGS. 1 – 3, the rims of the two barrel halves **10*a* and 10*b* are externally reinforced by peripheral edge beads 12 and 13. An identical number of raised locking elements or teeth 14 are formed out of these beads and alternate along the circumference of the barrel with gaps 15 whose width is the same as that of the locking elements 14. Upon assembly of the barrel, the locking elements 14 of one half tightly fit into the spaces 15** separating the locking elements of the other half whose edge bead they axially overlap.

The free ends of locking elements 14 of each half carry raised bosses 16 coming to rest on the edge bead of the other half.

These bosses form two parallel annular crenelations, separated by a flat ring zone, around the circumference of the barrel at a certain distance from the midplane 11. A strap 17 of rectangular cross-section is inserted therebetween to hold the barrel halves together.

A liner in the form of a thin and flexible plastic gag 18 is placed against the inner wall of the barrel halves and is locked in the bungholes **10*c*** of the bottom of each half. The bag can be filled through this bunghole.

Before assembling the barrel, the bag 18 is inserted. Then the halves **10*a* and 10*b* are interfitted, and the locking elements 14 of barrel half 10*a* slide over the bead 13 of half 10*b*, the interleaved locking elements of half 10b sliding at the same time over bead 12 of half 10*a*. Then the strap 17 is laid in between their bosses 16** and tightened to force the locking elements of each barrel half into firm contact with the bead of the opposite half.

A set of tenons 19 project axially from the end face of each barrel half between any two locking elements, at a lesser distance from the barrel axis than the locking elements 14, these tenons being slightly narrower than the inter-teeth gaps 15. The tenons 19 alternate in both halves with axially extending mortises which register with the corresponding teeth 14 and receive the tenons of the opposite half when the barrel is assembled.

Figure 4:
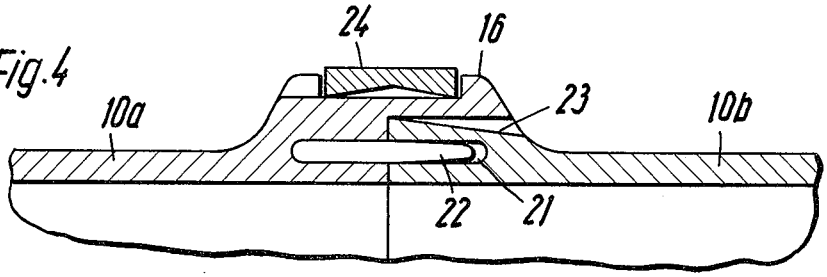
FIG. 4 is a fragmentary axial sectional view of a modified junction.
Figure 5:
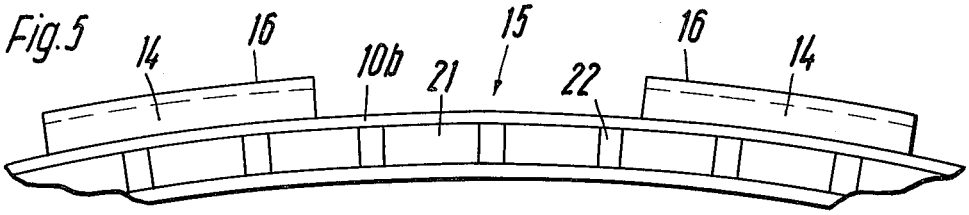
FIG. 5 is a view similar to FIG. 3 but relating to the modification of FIG. 4.

Such a supplemental fit is also achieved with the embodiment according to FIGS. 4 and 5. In this instance the barrel halves are provided with axially open annular grooves 21 at their end faces, with a number of peripherally spaced tongues 22 axially projecting therefrom over the circumference of the barrel. When the barrel halves are assembled, the tongues 22 of one half engage in the groove 21 of the other half. Since the tongues 22 are more numerous than the tenons 19 of the first embodiment, any damage to individual bracing elements during dead-freight transport has less influence upon the connection than with the arrangement of FIGS. 2 and 3.

The areas of beads 13 and 12 overlain by the locking elements 14 of the opposite barrel halves 10*a* and 10*b* are advantageously pitched, as shown at 23 in FIG. 4, to bring about an elastic connection of the barrel halves in axial direction. The areas 23, forming the bottoms of the gaps 15 of both barrel halves, slope outwardly toward the midplane 11. A strap 24 of double-trapezoidal cross-section slopes similarly form the edges to the middle of its inner surface, increasing in thickness from the middle toward these edges. The locking elements 14 could be similarly beveled, i.e. increased in thickness toward their free ends, in order to generate an axially effective biasing force as more fully described below.

In FIG. 4 the strap is shown slack, i.e. untensioned. Therefore, the locking elements are unstressed which is necessary for an easy assembly of the barrel halves. When the strap is being stressed, its heavier edge sections increasingly press the free tooth ends against the areas 23 which alternately slope in opposite directions from the common plane 11. This brings about an elastic axial stressing of the rim zones of the two barrel halves toward each other.

This wedging effect entails stronger resistance to a separating force acting in axial direction of the barrel, and also enhances the tendency of the assembly to restore its closely interlocking condition after such deformation.

In FIG. 1 we have shown several hoops 25 formed integrally with halves 10*a*, 10*b* on the outer wall of the barrel and projecting radially to at least the level of the bosses 16. The hoops 25, designed to protect the bracing and locking elements, are of L-shaped cross-section, facing away from midplane 11, and are provided with reinforcing ribs 26 situated between the legs of the L and the outer barrel wall.

While we have disclosed several embodiments of the present invention, it is to be understood that these embodiments are given by way of example only and not in a limiting sense.

We claim:

1. A barrel of plastic material comprising two symmetrical, axially separable halves with confronting end faces meeting at a midplane transverse to the barrel axis, each of said halves being provided in the vicinity of said midplane with a peripheral edge bead forming a set of axially extending teeth alternating with gaps of substantially like width, the teeth of each half overlying the edge bead of the other half and being received in the gaps thereof, said teeth having free ends provided beyond said midplane with radially upstanding bosses which form a pair of parallel annular crenelations bounding a substantially flat ring zone defined by the interleaved teeth of said halves, and a generally flat strap inserted under tension between said crenelations and bearing radially inwardly upon said ring zone, thereby forcing said free ends into firm contact with underlying areas of said edge beads forming the bottoms of said gaps, said edge beads being provided with axially extending bracing formations engaging each other across said midplane at locations radially inward from said ring zone.

2. A barrel as defined in claim 1 wherein said bracing formations are tenons and mortises alternating along the end face of each half.

3. A barrel as defined in claim 2 wherein said tenons and mortises are respectively aligned with the gaps and teeth of the corresponding halves.

4. A barrel as defined in claim 1 wherein said bracing formations are a pair of annular grooves on said end faces and a set of peripherally spaced tongues received in both grooves.

5. A barrel as defined in claim 1 wherein said underlying areas are pitched with a radially inward slope away from said midplane, said strap being provided with edge portions of increased thickness bearing upon said free ends for exerting upon said teeth a wedging effect giving rise to an axial biasing force tending to hold said halves together.

6. A barrel as defined in claim 1 wherein said halves are provided with integral external hoops adjacent said edge beads rising at least to the level of said bosses.

7. A barrel as defined in claim 1 wherein said hoops are of substantially L-shaped cross-section facing away from said midplane.

8. A barrel as defined in claim 7 wherein said hoops are provided with reinforcing ribs between the legs of the L and the outer surfaces of said halves.

* * * * *